United States Patent [19]

Luijten et al.

[11] 4,270,882

[45] Jun. 2, 1981

[54] MOLECULAR PUMP OR, RESPECTIVELY, GAS-TIGHT SEALING ARRANGEMENT FOR A BODY PLACED IN A HOUSING AND RAPIDLY ROTATING ABOUT AN AXIS

[75] Inventors: Waltherus J. Th. H. Luijten, Eindhoven; Joost Smid, Alkmaar, both of Netherlands

[73] Assignee: Ultra-Centrifuge Nederland N.V., The Hague, Netherlands

[21] Appl. No.: 860,777

[22] Filed: Dec. 15, 1977

[30] Foreign Application Priority Data

Feb. 25, 1977 [NL] Netherlands ..... 7702017

[51] Int. Cl.[2] ..... F04B 3/02; F01B 1/34

[52] U.S. Cl. ..... 415/72; 415/90; 277/134

[58] Field of Search ..... 415/72, 90, 73; 308/10, 308/159; 417/424; 277/134

[56] References Cited

U.S. PATENT DOCUMENTS

| | | | |
|---|---|---|---|
| 2,730,297 | 1/1956 | Dorsten et al. | 415/72 |
| 3,071,384 | 11/1963 | Friberg | 277/3 |
| 3,131,942 | 5/1964 | Ertaud | 277/134 |
| 3,246,901 | 4/1966 | Wickli | 277/134 |
| 3,813,134 | 5/1974 | Wijnant et al. | 308/159 |
| 4,002,378 | 1/1977 | Meinke | 308/10 |
| 4,036,565 | 7/1977 | Becker | 415/90 |
| 4,116,501 | 9/1978 | Mötz et al. | 308/159 |

FOREIGN PATENT DOCUMENTS

| | | | |
|---|---|---|---|
| 1265281 | 5/1961 | France | 415/72 |
| 372521 | 11/1963 | Switzerland | 308/10 |

*Primary Examiner*—Louis J. Casaregola

*Attorney, Agent, or Firm*—Cushman, Darby & Cushman

[57] ABSTRACT

Gastight seal for a rotary shaft or a cylindrical resp. cylindrical like body, the seal being of the type using a molecular gas, which seal has properties that automatically will stabilize the rotor, if whirl phenomena exited by gasforces have temporarily given rise to a precessional movement.

6 Claims, 3 Drawing Figures

Figure 1:
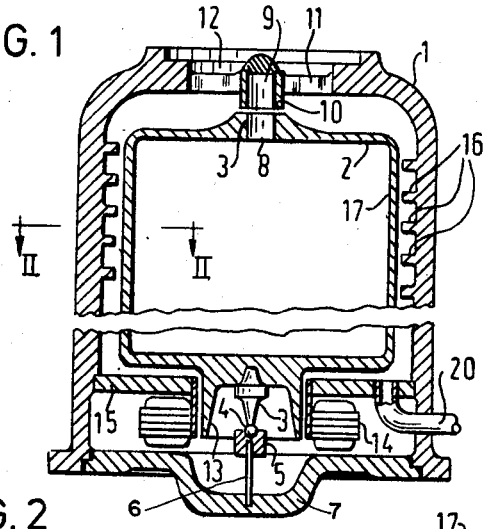

MOLECULAR PUMP OR, RESPECTIVELY, GAS-TIGHT SEALING ARRANGEMENT FOR A BODY PLACED IN A HOUSING AND RAPIDLY ROTATING ABOUT AN AXIS

The invention relates to a molecular pump or, respectively, a gas-tight sealing arrangement for a body—hereafter called rotor—placed in a housing and rapidly rotating about an axis, which sealing arrangement is mounted in this casing or, respectively, in a wall thereof, said sealing arrangement consisting of a stationary bush wall portion and an opposite moving bush wall portion of the body which is in the form of a body of rotation bounded on the outside by a generated surface so that there is at least one sealing gap between these wall portions, where at least one of these wall portions is provided with at least one salient helical resp. spiral dam which with the other wall portion bounds at least one continuous screw- or spiral thread.

Such a device is known, for example, from U.S. Pat. No. 2,730,297.

In practice it appeared however that such known devices cannot very well be operated at a very high speed of rotation. A very high speed of rotation is here intended to mean a speed in excess of the critical speed of the rotor. The vibrations which occur while this critical speed is passed and the accompanying high bearing losses appear to form an obstacle. According to the invention these difficulties are met by supporting the rotor elastically so that it can work supercritically and besides adjust itself so that its centre of gravity coincides with the axis of rotation. The latter adjustment is possible without trouble if the support is made sufficiently elastic. Since during operation at speeds above critical the centre of gravity comes to lie as of itself in the axis of rotation, the bearing reactions become much smaller and ultimately disappear altogether. This ensures not only a very quiet running, but the bearing loss is also reduced to a minimum.

E.g., the rotor can be supported elastically by providing it with thin and flexible axle journals. It is also possible to use a magnetic support.

With a support as described above it is however necessary to design the sealing so that a stabilizing effect is produced under all circumstances, and where the molecular sealing can temporarily behave in some degree as a gas bearing. But on the other hand, care must be taken that the gas forces do not become large enough to give rise to a whirl phenomenon as a result of which the rotor could start executing a precessional movement.

To prevent this from happening, the relation between the dam section measured in the circumferential direction and the groove section also measured in the circumferential direction is made, according to the invention, smaller than 0.6 but larger than 0.3.

To optimalize the device still further, care must also be taken to improve the stiffness. To achieve this aim, the angle between a tangent to the helical dam and a plane normal to the axis is made to be smaller than 0.20 but larger than 0.05, expressed in radians.

This is further contributed to by designing the device so that the relation between the depth of the helical thread and the smallest radial dimension of the sealing gap is at least 5.

The intended damping effects manifest themselves in particular when the pressure in the pump or in the bush undergoes a sudden rise owing to some working conditions. In such cases a whirl can actually occur temporarily. The suppression of this whirl is very important because a continuing whirling motion could lead to the rotor fouling in the relatively narrow gap. The applicant has, however, come to the conclusion that it is possible to design sealings which have a centering effect. In particular it appeared that the centering forces outside the screw thread centre with respect to the housing while the centering forces inside the sealing screw thread centre with respect to its axis.

Figure 2:
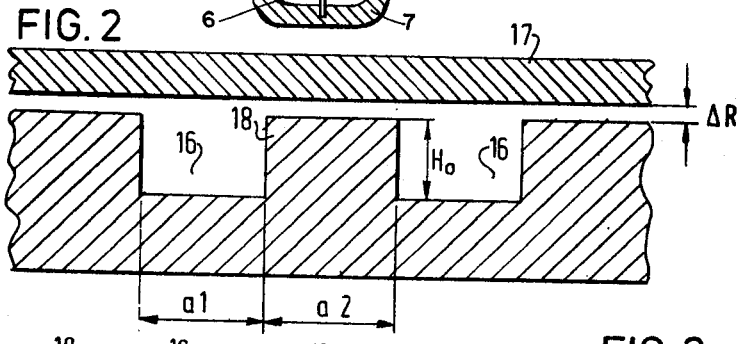
Figure 3:
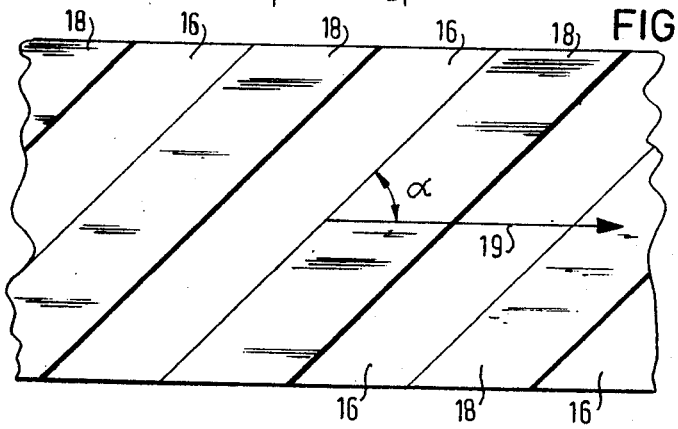

The invention will now be described more fully with reference to a few embodiments illustrated in the following drawing, in which:

FIG. 1 is a vertical cross section of a molecular pump with the invention applied, FIG. 2 is a detailed illustration of a developed portion of the housing wall cut in the circumferential direction, and FIG. 3 is an external view of a developed wall portion provided with helical channels.

The molecular pump illustrated in FIG. 1 is provided with a housing 1 in which a rotor 2 is placed. This is supported via a footstep 3, terminating in a footstep ball 4, in a footstep bearing 5 which is flexibly attached to a thin rod clamped in the bottom 7 of the housing 1. Because the rod 6 is thin it is capable of permitting radial deflections where, however, the centre position is always sought again owing to the elasticity of rod 6. The rotor 2 is provided on top with a bore 3 in which, in the embodiment shown, a rod-shaped magnet 8 is secured. Opposite this magnet 8 there is a stationary magnet 9 mounted so that unlike poles of these magnets face one another and the magnets thus attract each other. Magnet 9 is mounted inside a tube 10 which is fixed in the suction opening 12 of the pump by means of thin spokes 11. The rotor 2 is fitted on its lower side with a cylindrical sleeve 13 which serves as the rotor of an electric motor and is driven by a stator 14. This stator is secured to a partition 15 mounted in the lower part of the housing 1. The inside of the cylindrical wall of housing 1 is fitted with a screw thread 16 which cooperates with the cylindrical wall 17 of rotor 2. The partition 15 is provided with an outlet duct 20 which discharges the gas compressed by the pump.

FIG. 2 represents a magnified view of part of the screw thread unwound into a plane, with the wall 17 lying opposite. This figure shows that the dimension of a screw thread, measured in the circumferential direction, is $a_1$, whereas the dimension of a dam 18, also measured in the circumferential direction, is $a_2$. The height of such a dam is $H_o$, whereas the width of the gap measured between the wall 17 and the outermost part of a dam 18 is $\Delta R$. Experiments have shown that, to achieve a good self-centring action, the following relations are essential: If $$\gamma = a_2/a_1$$

the following relation should hold:

$$0.3 < \gamma < 0.8$$

It is also necessary that (see FIG. 3):

$$0.05 < \alpha < 0.20$$

where $\alpha$ is expressed in radians.

At the same time it is necessary that $a_1/H_o > 0.8$. Finally the relation $h_o < 5$ should hold, where $$h_o = H_o/\Delta R$$

$\Delta R$ here represents the radial clearance between the rotor and the dams of the molecular pump or, respectively, the sealing. $H_o$ is the radial depth of a screw thread.

In view of the above, FIG. 3 should hardly need any explanation.

In this figure, which illustrates the inner circumference of the inner wall of the housing 1 lined with grooves 16 and dams 18, with both grooves and dams developed in a plane, the velocity vector 19 is also shown, representing the direction and magnitude of the velocity at which the wall 17 moves along the grooves and dams.

We claim:

1. In a high vacuum gas tight sealing assembly: a body of revolution mounted for rotation within a housing with a gap between the inside surface of said housing and the outside surface of said body, one of said surfaces at the location of the gap being provided with at least one continuous helical groove which forms a salient helical dam, the ratio between the dam dimension in the circumferential direction and the groove dimension also measured in the circumferential direction is smaller than 0.8 and larger than 0.3, and means elastically supporting said body so that said body can adjust itself laterally.

2. Sealing assembly as in claim 1, wherein the angle between a tangent to the helical dam and a plane normal to the axis of revolution expressed in radians is smaller than 0.20 and larger than 0.05.

3. Sealing assembly as in claim 2, wherein the value of the ratio between the depth of the helical groove and the smallest radial dimension of the sealing gap is at least 3.

4. Sealing assembly as in claim 1, wherein the ratio between the width of the groove and the depth of the groove is larger than 0.8.

5. Sealing assembly as in claim 4 wherein said body of revolution is the rotor of a high vacuum molecular pump, said housing having a suction opening and a discharge opening located at opposite ends of the gap, and means for rotating said body at a speed in excess of its critical speed.

6. Sealing assembly as in claim 1 wherein said axis of rotation is vertical and wherein said means for elastically supporting said body of revolution includes at the lower end of said body a ball member rotatably received within a bearing cup member, one of said members being supported by a flexible vertical rod and the other of said members being carried by said body, said supporting means further including a magnetic bearing at the upper end of said body.

* * * * *